United States Patent [19]

Steeman

[11] 4,245,699

[45] Jan. 20, 1981

[54] METHOD FOR IN-SITU RECOVERY OF METHANE FROM DEEPLY BURIED COAL SEAMS

[75] Inventor: Johannes W. M. Steeman, Geleen, Netherlands

[73] Assignee: Stamicarbon, B.V., Geleen, Netherlands

[21] Appl. No.: 971,064

[22] Filed: Dec. 19, 1978

[30] Foreign Application Priority Data

Jan. 2, 1978 [NL] Netherlands ..... 7800005

[51] Int. Cl.[3] ..... E21B 43/25

[52] U.S. Cl. ..... 166/271; 166/308; 299/2; 299/12; 299/17

[58] Field of Search ..... 166/271, 314, 271, 308; 299/2, 17, 12

[56] References Cited

U.S. PATENT DOCUMENTS

| | | | |
|---|---|---|---|
| 3,529,867 | 9/1970 | Vande Sande | 299/2 |
| 3,650,564 | 3/1972 | Williamson | 299/12 |
| 3,743,353 | 7/1973 | Blackwell et al. | 299/12 |
| 3,814,480 | 6/1974 | Dahl | 299/2 |
| 3,934,649 | 1/1976 | Pasini et al. | 299/12 |
| 3,961,824 | 6/1976 | Eck et al. | 299/17 |
| 4,089,374 | 5/1978 | Terry | 166/314 |

*Primary Examiner*—William F. Pate, III

*Attorney, Agent, or Firm*—Cushman, Darby & Cushman

[57] ABSTRACT

An improved method for the in situ recovery of methane from a plurality of coal seams beneath the earth's surface. At least one borehole is driven from the surface into a selected coal seam wherein a plurality of cavities are formed. The coal walls intermediate said cavities and the strata overlying said cavities are caused to collapse suddenly thereby forming fissure systems into the coal bearing rock strata from which methane is released. The methane is withdrawn via the fissure systems, cavities and the borehole. The cavities may be formed by chemical, physical or mechanical recovery of the coal.

11 Claims, 1 Drawing Figure

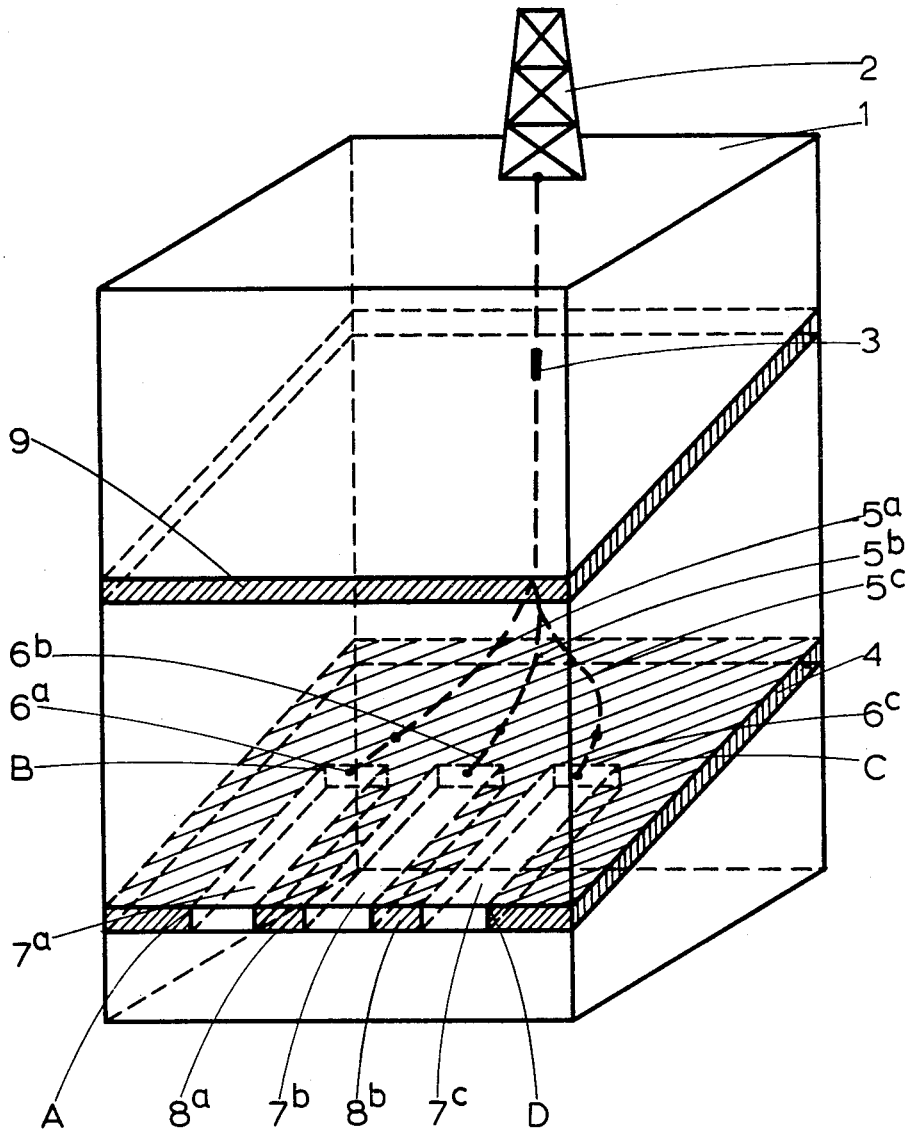
2
1
3
9
5a
5b
5c
6b
4
6a
6c
B
C
7a
A
8a
7b
8b
7c
D

METHOD FOR IN-SITU RECOVERY OF METHANE FROM DEEPLY BURIED COAL SEAMS

BACKGROUND OF THE INVENTION

The invention relates to a method for the in situ recovery of methane from a plurality of coal seams at the same time by forming a fissure system over and under a selected coal seam extending into a coal bearing rock strata, and recovering methane via the fissure systems and at least one borehole.

It is known that during the collapse or caving in of a void resulting from the removal of coal by mining the seam, a more or less vertical fissure system is formed in the rock strata over and under the caved in void, and the rock strata move apart to some degree under the influence of subsidence (bed-separation). In this way an extensive system of fissures is formed which may extend through unworked coal seams. Such a fissure system may reach to about 120 meters above, and about 100 meters below the caved in void (see Geologie en Mijnbouw, 41, 1962, pp. 41–44 and p. 53). The coal seems located within the range of the fissure system can thus release all or part of their adsorbed methane into the fissure system, provided that the pressure prevailing there is lower than the pressure of the methane adsorbed in the coal seams concerned.

The volume of methane that can be recovered by such a procedure is usually a multiple of the volume that has issued alone from the mined coal seam from which the fissures were initiated. This is because the fissured rock strata over and under the collapsed coal seam usually contain a plurality of additional coal seams, each of which will release a given volume of methane through the fissure system. If the geological build-up of the strata system is known, the volume of methane likely to be released through the fissure system can be accurately calculated from several parameters. The value of these parameters usually differs from one coal field to another. See, for example, Geologie en Mijnbouw, 41, 1962, pp. 55–57.

Using the Netherlands for purposes of illustration, it is known that there is a coal deposit at depths of 1000–5000 meters under substantially the whole of the Netherlands and large parts of The North Sea. This coal deposit has a thickness of at least 20 meters, measured as the joint thickness of all coal seams. The quantity of coal present within an area of, say, $100\times100$ kilometers or $10^{10}$ square meters can thus be estimated to be $2\times10^{11}$ cubic meters. If it is assumed that an average of 10 cubic meters of methane are absorbed per cubic meter of coal, then it follows that the quantity of methane adsorbed to the coal within such area is about $2\times10^{12}$ cubic meters. The above assumption of 10 cubic meters of methane per cubic meter of coal is reasonable, considering that in the 'Peel' area about 10 cubic meters of methane have been measured per cubic meter of coal, and in South Limburg about 17 cubic meters of methane have been measured per cubic meter of coal. See the report of the Peel committee, proceedings of K.N.G.M.G. Mining series, part 5, page 83. The above calculated volume of methane is equivalent to the content of the Groningen gasfield, and thus the reserves of methane in the Netherland's sub-soil and under parts of the North Sea bottom is equal to a multiple of the reserves at Groningen, which is one of the biggest of the world. If at least a portion of this methane could be recovered, no shortage of natural gas would occur in the Netherlands for a long time to come. An equivalent calculation could be made for other coal fields in other parts of the world, except the parameters such as the total thickness of coal seams and the quantity of adsorbed methane would vary.

Methods are also known to recover gas adsorbed to coal through boreholes by increasing the permeability of the strata immediately over a coal seam. Such methods used for this purpose are generally known from the mineral oil industry and include, for example, hydraulic fracturing or hydraulic lifting of the rock overlying the said coal seam, and filling the resulting void with sand. Such a procedure has been used at Klarenthal colliery in the Saar district, see, for example, Annales des Mines de Blegique, 1, 1976, p. 25. Such methods are effective for degassing a single coal seam, but if a number of coal seems are involved, frequent repetition of the same process is required in order to recover the gas, thus entailing rather high expense.

It is suggested in Annales des Mines de Belgique, 1, 1976, pp. 25–26, that application of one additional borehole would enable methane to be recovered in an analogous manner from coal seams located in a fissure system over a coal combustion area. However, apart from needing additional boreholes, there is the possibility that the presence of such boreholes in the fissure system may cause complications during the coal combustion process. Furthermore, it is reasonable to assume that no adsorbed methane would be released at the elevated pressures in the combustion process.

SUMMARY OF THE INVENTION

It is an object of this invention to provide a relatively simple and inexpensive method for the in situ recovery of methane from underground coal deposits by recovering methane simultaneously from a plurality of coal seams by generating a fissure system in the coal seam bearing rock strata through which fissure system the coal seams can degasify, and discharging the released gas through at least one borehole.

This and other objectives are accomplished, according to this invention, by driving at least one borehole from the earth's surface into at least one selected coal seam. This borehole can be cased if and wherever necessary. A plurality of cavities are then formed within the plane of the selected coal seam via this borehole in a manner to provide intermediate coal walls between the individual cavities. The strata overlying the cavities and the intermediate coal walls are then caused to collapse suddenly, thereby forming a fissure system above and below the selected coal seam and extending into other coal seams of the coal bearing rock strata. If the pressure within the borehole, the collapsed cavities and the resulting fissure system is sufficiently low, methane will be released, via the fissures onto the collapsed cavities, which methane can be withdrawn from the cavities via the borehole. To recover as much as possible of the methane in the coal by desorption the residual overpressure within the fissure system, cavities and boreholes should preferably be less than 0.1 MPa.

The advantage of recovering methane present in the coal seams in situ is that the methane is released, and can be recovered in substantially pure form. This is in contrast to the gas produced during the recovery methods involving the in situ combustion of coal.

The intermediate coal walls and subsequently the strata overlying the cavities and walls can be caused to collapse by firstly forming the cavities and thereafter reducing the bearing force of at least one coal wall to cause the sudden collapse under the influence of the total static rock pressure.

In practice this can be realized by diminishing the dimensions of preferably one selected coal wall thus causing this wall to collapse under the static rockpressure. Subsequently the bearing force of the remaining walls is exceeded and is followed by the sudden collapse of these walls and the overlying strata, thereby forming the fissure systems.

According to an embodiment the selected wall is caused to collapse by explosives.

It will be understood that by sudden is meant a period of a few minutes to about one day, strongly depending of the geological circumstances.

Preferably however, the cavities are formed under an applied fluid pressure, acting contrary to the static rock pressure, of sufficient magnitude to prevent the premature collapse of the cavities being formed until the chosen width of the cavities and intermediate coal walls is obtained. Thereafter, this fluid pressure can be released until the coal walls and overlying rock strata suddenly collapse, thereby forming the fissure systems. Ideally, hydrostatic pressure of the fluid column of the borehole is used for this purpose.

It should also be possible to form the cavities required for this invention by chemical and/or physical removal of the coal from the cavities to be formed, but conditions required for such cavity forming techniques are less suited for application to the method of this invention. Specifically, a larger number of boreholes would be needed, and it is much more difficult to control the required and well defined dimensions of the cavities and intermediate coal walls.

For the above reasons, the cavities are preferably formed by mechanical means. Very well suited for this purpose is the coal-working equipment described in U.S. Pat. No. 3,961,824 or variations thereof. This equipment is essentially a sectional scraper structure adapted to be introduced down to a mineral formation through a borehole in extended form and then folded into a zig-zag position in the mineral formation. The zig-zagged scraper is then reciprocated or moved in an up and down manner from the surface so as to dislodge coal from the wall of the borehole. The dislodged coal is carried off by flushing fluid through the borehole. The length and width of the cavity formed by such mechanical means can be controled and varied, and a suitable pattern of cavities can thus be formed, such as illustrated in the drawing or in FIG. 1 of U.S. Pat. No. 3,961,824.

The appropriate width of the cavities and the intermediate coal walls for effectively carrying out the present method vary depending upon, for example, the composition and the mechanical-physical properties of the overlying rock up to a distance of some tens of meters over such cavity, the mechanical-physical properties of the coal, the natural cleavage, and the hydrostatic counter-pressure applied during the cavity formation. These conditions of the rock and coal can be ascertained from drilling cores extracted from the borehole concerned. From these conditions, the depth of the selected coal seam and the related static rock pressure, the necessary hydrostatic counter-pressure and the required dimensions of the cavity and intermediate coal walls can be determined. This information can also be determined empirically.

Collapse of the intermediate coal walls and rock strata overlying the cavities can be prevented by the application of a sufficiently high hydrostatic counter-pressure. Relieving this hydrostatic counter-pressure to effect the collapse required in the present invention can be done in a very simple manner by emptying one or more of the cavities by introducing a compressed gas such as air, methane or nitrogen, into the cavities along a separate conduit through the boreholes.

The caved-in area thus formed must be de-watered as thoroughly as possible in order to bring the residual pressure down to a low enough value to permit the substantially complete release of the gas adsorbed in the coal seams. Water present in the collapsed cavity can also be pumped out by means of apparatus or facilities known in the oil industry, if necessary through a separate borehole. Furthermore, if there is a natural influx of water into the collapsed cavity, means must be provided to either continuously or discontinuously keep the area free from water.

After the collapse and the resultant formation of the fissure system, the adsorbed methane in the coal seams within the range of the fissure system will be released, and, under a slight overpressure will flow through the fissure system and the collapsed cavity to the base of a borehole from where it can be recovered in substantially pure form.

DETAILED DESCRIPTION OF THE INVENTION

The invention, in its preferred embodiment, will be elucidated in detail with reference to the drawing.

A borehole 3 is driven down from the surface of the earth 1 by a drilling installation 2. At a point some distance above the selected coal seam 4 this borehole is made to deviate some angle from the axis of borehole 3 to make deviating section 5*a* of borehole 3, which enters into coal seam 4 at a relatively small angle at point 6*a*. The borehole is thereupon driven further in the plane of coal seam 4, and thereafter widened by means of the mechanical apparatus described above, or some other means, to form cavity 7*a*. Only a small cross-sectional portion of chamber 7*a* is shown in the drawing, and it may have a length of several hundred meters.

Next, a second deviating section 5*b* is driven from borehole 3 into coal seam 4 at point 6*a*, wherein it is further driven and widened as discussed above to form cavity 7*b*. In the same manner, a third deviating section 5*c* is drilled and widened to form chamber 7*c*. In the same manner, a number of further cavities not shown in the drawing can be formed around single borehole 3.

Preferably, the above operations are carred out under an elevated hydrostatic pressure so as to prevent the premature collapse of the cavities formed and thereafter enabeling a sudden collapse. The cavities are formed so as to leave intermediate coal walls 8*a* and 8*b* between cavities 7*a*, 7*b* and 7*c*, the width of such intermediate coal walls being calculated given due consideration to the above-mentioned characteristics of the overlying strata, as well as the hydrostatic pressure to be applied.

When the cavities have been appropriately formed and widened, the hydrostatic pressure is then relieved, for example, by means of a gas introduced along a line leading through borehole 3, deviating section 5 and into one or more of chambers 7. As a result of the decrease in hydrostatic pressure, the static rock pressure will cause intermediate coal walls 8a and 8b to collapse suddenly and the rock strata over cavities 7a, 7b, and 7c to cave into the cavities. The resulting caved in area extends between points A, B, C and D in the FIGURE, and of course would extend further in the event that additional cavities had been formed. Fissure systems are formed both over and under this cave in area, which may measure several hundred meters in both length and width, extending into at least one other coal seam 9. The methane released within the fissure system formed within caved in area A, B, C and D is withdrawn to the surface via the fissure system to one or more of cavities 7, through one or more of deviating sections 5 and up through borehole 3 to surface 1. As a result of the sudden pressure release, the coal walls may disintegrate spontaneously under the influence of the methane adsorbed in the coal, to release the gas as in the case of 'sudden gas outbursts'.

In order to maintain the high hydrostatic pressure during the formation of the cavities, the coal entrained by the flushing fluid would have to be carried off through a lock system. Many varying types of such lock systems are known in the practice of hydraulic coal transport.

The following numerical example is presented to give an impression of the probable gas volume that might be obtainable in a given situation. In this example it is assumed that the system of strata of coal seams contains 15 cubic meters of adsorbed methane per cubic meter of coal, and seam 4 is largely removed to a height of one meter and the area around the cavity thus formed is made to cave in. It is further assumed that five seams are located at distances of 10, 20, 30, 40, 80 and 100 meters over seam 4, measuring 0.8 m, 1.5 m, 1.0 m, 0.5 m, 1.5 m and 1.0 m, respectively, in height. Another five seams are located at a distance of 10, 20, 40, 60 and 80 meters under seam 4, which seams have a height of 0.8 m, 1.5 m, 1.0 m, 0.5 m and 1.5 m, respectively. Using the method of calculation described in Geologie en Mijnbouw, 41, 1962, it can be calculated that over 70 cubic meters of methane will be released per square meter of caved-in area. Extrapolating this over a created cave-in area of 200×300 meters, this would be equivalent to over 4 million cubic meters of methane. Since coal is also produced, for example 30,000 cubic meters of the 60,000 cubic meters present, the residual cost price of the methane covered is relatively low after deduction of the revenue realized from these approximately 30,000 tons of coal output. The remainder of the coal remains behind in the form of the collapsed intermediate coal walls.

It should be appreciated that several strata systems can be worked by the same method from a single borehole 3. If the entire stratigraphic profile, including the distances between and the thicknesses of the coal seams, as well as the probable methane contents are known, the most suitable strata formations and the coals seams to be selected for removal can be fairly easily determined by computer.

It should further be appreciated that an additional advantage of the present method is that the deviating sections 5a, 5b and 5c can be placed so as to enable borehole 3 to be positioned outside of the fission area to be formed around the cavity, so that the borehole will not sustain damage from the rupture.

It thus can be seen that by the above described combination of techniques and principles, a method is provided whereby it is now possible to efficiently and effectively recover methane simultaneously from a large number of coal seams by the intentional and controlled formation of a massive fissure system and the withdrawal of methane thereby released. Essential however in applying the combination of the techniques and principles is the notion to form the fissure systems over a rather large area of the coal bearing rock strata by causing a sudden collapse of the intermediate coal walls between the cavities.

What is claimed is:

1. An improved method for the in situ recovery of methane from a plurality of coal seams beneath the earth's surface by forming a fissure system extending into coal bearing rock strata, the method essentially comprising the combination of steps of:

driving at least one borehole from the surface into a selected coal seam, which borehole is at least partially cased;

forming, via said at least one borehole, a plurality of cavities within the plane of said coal seam, with intermediate coal walls between said cavities;

causing the sudden collapse of said coal walls, and the collapse of the strata overlying said cavities and coal walls, into said cavities thereby forming a fissure system above and below said coal seam, extending into other coal seams in said coal bearing rock strata;

causing the pressure within said collapsed cavities and fissure system to be at most about atmospheric;

causing the release and flow of methane via said fissure system into said collapsed cavities; and withdrawing methane from said collapsed cavities via said at least one borehole.

2. The method of claim 1, wherein the residual overpressure within said collapsed cavities at the time of withdrawing said methane is less than 0.1 MPa.

3. The method of claim 1, wherein the said intermediate coal walls are caused to collapse by firstly forming the said cavities and thereafter reducing the bearing force of at least one coal wall to cause the said sudden collapse under the influence of the total static pressure of the rock strata.

4. The method of claim 1, wherein said cavities are formed by a means selected from the group consisting of chemical and physical removal of coal from said cavity to be formed.

5. The method of claim 1, wherein said cavities are formed by mechanical means.

6. The method of claim 1, wherein water is removed from said collapsed cavity via a separate borehole.

7. The method of claim 1, wherein a plurality of strata systems are degassed with more than one selected coal seam, via a single borehole.

8. The method of claim 1, wherein said cavities are so positioned relative to said at least one borehole that said borehole will not be within the fissure systems formed.

9. An improved method for the in situ recovery of methane from a plurality of coal seams beneath the earth's surface by forming a fissure system extending into coal bearing rock strata, the method essentially comprising the combination of steps of:

driving at least one borehole from the surface into a selected coal seam, which borehole is at least partially cased;

forming, via said at least one borehole, a plurality of cavities within the plane of said coal seam, with intermediate coal walls between said cavities, while applying fluid pressure within said cavity to prevent the collapse of said intermediate coal walls said overlying rock strata during the formation of said cavity;

reducing the pressure of said fluid thereby causing a sudden collapse of said coal walls, and the collapse of the strata overlying said cavities and coal walls, into said cavities thereby forming a fissure system above and below said coal seam, extending into other coal seams in said coal bearing rock strata;

causing the pressure within said collapsed cavities and fissure system to be at most about atmospheric;

causing the release and flow of methane via said fissure system into said collapsed cavities; and withdrawing methane from said collapsed cavities via said at least one borehole.

10. The method of claim 9, wherein said fluid pressure is the hydrostatic pressure of the fluid column of the said at least one borehole.

11. The method of claim 10, wherein said hydrostatic pressure is reduced by introducing a compressed gas into at least one cavity through a separate conduit through the borehole and removing at least a portion of said fluid.

* * * * *